United States Patent [19]

Jansen et al.

[11] 4,405,835

[45] Sep. 20, 1983

[54] RECEIVER FOR AM STEREO SIGNALS HAVING A CIRCUIT FOR REDUCING DISTORTION DUE TO OVERMODULATION

[75] Inventors: Winfried Jansen, Hasloh; Wolfgang Nolde, Hamburg, both of Fed. Rep. of Germany

[73] Assignee: U.S. Philips Corporation, New York, N.Y.

[21] Appl. No.: 301,567

[22] Filed: Sep. 14, 1981

[30] Foreign Application Priority Data

Dec. 16, 1980 [DE] Fed. Rep. of Germany ..... 3047386

[51] Int. Cl.[3] ..... H04H 5/00

[52] U.S. Cl. ..... 179/1 GS; 455/212

[58] Field of Search ..... 455/210–212; 179/1 GD, 1 GM, 1 GS; 329/135, 167

[56] References Cited

U.S. PATENT DOCUMENTS 3,076,057 1/1963 Baugh, Jr. ..... 455/210

4,107,613 8/1978 Queen et al. ..... 455/212

4,340,782 7/1982 Weigand et al. ..... 179/1 GS

FOREIGN PATENT DOCUMENTS 56-24838 3/1981 Japan ..... 179/1 GS

*Primary Examiner*—Jin F. Ng

*Attorney, Agent, or Firm*—Thomas A. Briody; William J. Streeter; Edward W. Goodman

[57] ABSTRACT

A receiver for AM signals, in which the carrier is amplitude modulated with a first signal (L+R) and phase modulated with a second signal (L−R), includes a circuit for reducing distortion in the output signal due to amplitude overmodulation. This circuit includes an overmodulation detector for controlling a switch in a phase demodulation signal channel, which switch, coupled between a demodulator and an integrator in this signal channel, effectively short-circuits the input to the integrator causing the output thereof to remain constant for the duration of the overmodulation.

3 Claims, 2 Drawing Figures

RECEIVER FOR AM STEREO SIGNALS HAVING A CIRCUIT FOR REDUCING DISTORTION DUE TO OVERMODULATION

BACKGROUND OF THE INVENTION

The invention relates to a receiver for receiving AM-signals the carrier being frequency and phase modulated, which receiver comprises a signal channel having a frequency, or phase, demodulator. A receiver of this type is particularly suitable for the reception of medium-wave stereo signals, the carrier being amplitude-modulated by the sum signal and phase-modulated by the difference signal. Such a receiver is described in co-pending U.S. patent application Ser. No. 259,797, filed May 4, 1981.

With a receiver of the above-described type amplitude overmodulation may result in significant distortions on reception. In the event of overmodulation, the amplitude of the signal, which is amplitude-modulated on the carrier or the so-called envelope, is larger than or equal to the amplitude of the carrier or, put differently: the amplitude modulation factor is larger than or equal to 1 (or 100%). Such distortions are particularly noticeable in the (difference) signal channel in which the phase demodulator is located, while they are not very disturbing in the other (sum) signal channel in which the amplitude demodulator is located, particularly when the overmodulation is moderate.

SUMMARY OF THE INVENTION

The invention has for its object to reduce, in a receiver of the type defined in the preamble, the distortions in the output signal of the signal channel in which the frequency, or phase, demodulator is included at the occurrence of overmodulation.

According to the invention, a receiver is therefore characterized by an electronic switch for blocking and releasing the last-mentioned signal channel, said electronic switch being controlled by an overmodulation detector which is energized by an overmodulation of the carrier by the AM signal.

An overmodulation results in sudden frequency and phase transients, which manifest themselves at the output of the frequency or phase demodulator, respectively, as interference pulses.

An overmodulation may alternatively occur, for example, if the carrier drops out. The envelope of a signal with overmodulation passes through zero, the carrier phase then changing over 180°. In practice, the transmitter signal is, however, equal to zero for the duration of an overmodulation. On the one hand, these effects are caused by the distortions mentioned in the preamble; on the other hand they also represent the criteria by which the overmodulation detector may be energized.

The switch must then be arranged such that the signal path to the overmodulation detector is not interrupted by the blocking of the signal channel. If possible, the delay of the signal in the signal channel must be such that in the event of an overmodulation, the switch blocks the signal channel when the distortion resulting from the overmodulation reaches the switch or just prior thereto.

It should be noted that the prior U.S. patent application Ser. No. 259,797 also shows a switch for blocking and releasing the signal channel. However, said switch serves only as a mono-stereo switch, the control of which does not follow a rapid change in the receiving conditions.

A further embodiment of a receiver in accordance with the invention is characterized in that the input signal of the overmodulation detector is derived from the signal path before the demodulator and that the overmodulation detector is of such a form that it is activated at the disappearance of the carrier.

In this further embodiment use is made of the above-mentioned fact that, in practice, the carrier drops out during an overmodulation. If then the switch is provided in that part of the signal channel behind the demodulator, the delay of the signal in the demodulator itself is generally of a sufficient duration to ensure that the signal distorted by the overmodulation does not reach the switch until after it has already been opened.

It is, however, also possible to connect the overmodulation detector to the output of the frequency and phase demodulators, respectively.

A still further embodiment of the receiver in accordance with the invention is characterized in that the overmodulation detector comprises a threshold value switch to which the input signal is applied via a rectifier circuit, the time constant of which is small compared to the period of the signal which is amplitude-modulated on the carrier, but large compared to the period of the carrier.

The rectifier circuit produces a signal which has only one polarity, the time constant ensuring that the output signal thereof and the input signal of the threshold value switch, respectively, can indeed follow the envelope, but not the carrier signal. The threshold value switch must then be adjusted such that it generates a control signal for blocking the signal channel.

A further embodiment of such a receiver in accordance with the invention is characterized in that the demodulator comprises a FM-demodulator and a subsequent integrator and that the switch is connected between the FM-demodulator and the integrator.

This further embodiment is based on the recognition of the fact that at a frequency-demodulator which is not accurately adjusted to the intermediate frequency, a voltage shift is produced which is integrated by the integrator, so that the output voltage thereof may attain a maximum value already in the event of a single overmodulation carrier drop out. The switch provided between the FM-demodulator and the integrator prevents such a voltage shift, so that the voltage at the output of the integrator remains constant for the duration of the overmodulation.

Preferably, the switch is then arranged in a signal short-circuiting path and controlled by the overmodulation detector such that it short-circuits the integrator input in the event of overmodulation. When arranging the switch serially in the signal path, the integrator output voltage might change during the overmodulation as a result of the leakage currents which inevitably flow through the electronic switch.

DESCRIPTION OF THE DRAWING

The invention will now be further explained by way of non-limitative example with reference to the accompanying drawing.

DESCRIPTION OF THE PREFERRED EMBODIMENT

Figure 1:
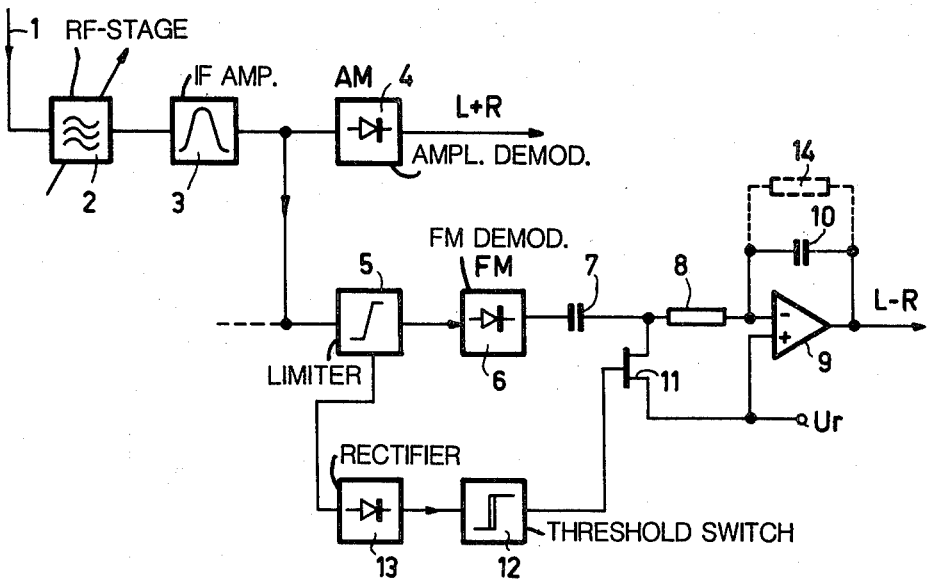
FIG. 1 shows a block-schematic circuit diagram of a receiver in accordance with the invention.

FIG. 1 shows a portion of the block schematic circuit diagram of a medium wave receiver which is suitable for receiving a stereo signal, the sum signal being amplitude-modulated on the carrier and the difference signal being phase-modulated on the carrier. The input signal is applied by an aerial 1 to the input of the radio-frequency stage 2, which is provided in known manner with an input stage (filter stage), a tunable oscillator and a mixer stage and which produces an output signal in the intermediate frequency range, for example at 455 KHz. The output of the radio-frequency stage is connected to an intermediate frequency amplifier 3 in which the signal is selected and amplified.

The output signal of the intermediate-frequency amplifier 3 is applied to an amplitude-demodulator 4, whose output signal corresponds to the sum signal L+R. In addition, the output signal of the intermediate-frequency amplifier 3 is applied to a limiter stage 5, which produces an output signal the amplitude of which is constant in a wide range of the input voltage and therefore independent of the amplitude of the input voltage. In this limiter stage 5 the superimposed (L+R) amplitude modulation is removed from the input signal of the limiter stage. The output signal of the limiter stage 5 is applied to an FM-demodulator 6 and, via a decoupling capacitor 7, on to an integrator comprising an operational amplifier 9, the inverting input of which is connected to the capacitor 7 via a resistor 8 and to the amplifier output via a capacitor 10. The non-inverting input of the operational amplifier 9 is connected to a reference voltage $U_r$.

The frequency demodulator 6 forms a phase demodulator in conjunction with the integrator 8. . .10. The output signal of said phase demodulator corresponds normally to the difference signal L−R. This difference signal, eventually after phase reversal, is combined with the output signal of the amplitude demodulator 4 in a dematrixing circuit, not shown, at the output of which the signals L and R are separately available. Up to this point the circuit is already described in the prior U.S. patent application Ser. No. 259,797.

In the event of overmodulation by the (sum) signal (L+R), which modulates the amplitude of the carrier, the output voltage of the intermediate frequency amplifier 3 is zero, or almost zero. Consequently, the input voltage of the limiter stage 5 has a constant value of zero, or almost zero, as well as the output voltage thereof. If the FM demodulator 6 is not accurately tuned to the intermediate frequency of 455 KHz, its output voltage deviates in that case from the temporary average value of the output signal of the limiter 5 prior to the appearance of the overmodulation. As a result thereof, there is produced at the output of the FM-demodulator 6 a step-wise voltage change which reaches the input of the integrator 8. . . 10 via the capacitor 7 and is integrated by said integrator. The output signal of the integrator 8. . . 10 increases linearly and may assume values which exceed the amplitude of the normal modulation, particularly if the frequency of the sum signal caused by the overmodulation is relatively low and the overmodulation consequently continues for a comparatively long period of time, or if the overmodulation occurs during the several consecutive signal periods.

The distortions resulting therefrom are suppressed by means of an electronic switch in the form of a field effect transistor 11. During the overmodulation the source-drain path of said field effect transistor 11 connects the non-inverting input of the operational amplifier 9 to the junction of the elements 7 and 8. During normal reception the field effect transistor 11 is cutoff.

During the overmodulation, the integrator input is short-circuited thereby so that the output voltage of the integrator remains constant for the duration of the overmodulation, that is to say for the period of time the transistor 11 is switched on. Signal distortions are considerably reduced thereby.

The gate of the field effect transistor 11 is connected to the output of a threshold value switch 12 which renders the field effect transistor 11 conductive when the voltage at its input decreases to below a predetermined threshold value. The input of the threshold value switch 12 is connected to the output of a rectifier 13 which has a time constant chosen between the period of the intermediate frequency carrier and the period of the amplitude-modulating signal. When using a full-wave rectifier for the rectifier 13, the time constant should be chosen between half the period of the intermediate frequency carrier and half the period of the amplitude-modulating signal. The input of the rectifier 13 is connected to a terminal of the limiter 5 at which the voltage has not yet been limited. Said input may however also be connected directly to the output of the intermediate frequency amplifier 3. So the output voltage of the rectifier 13 follows the envelope of the intermediate frequency signal. Owing to the disappearance of the carrier, which in practice occurs in the event of overmodulation, the output signal of the rectifier 13 has zero value during the overmodulation or at least assumes a very low value.

The limiter stage 5, the FM-demodulator 6, with the exception of its resonant circuits and the rectifier 13 may in practice be realized by means of an integrated circuit of the Valvo/Philips types TCA 420A or TDA 1576. Each of these integrated circuits has two output terminals for field strength indication, at which a voltage is present which corresponds to the logarithm of the amplitude of the input signal of the limiter stage 5. For this purpose signals, which corresponds to the logarithm of the magnitude of the input signal, are formed in the circuits, integration elements ensuring that the output voltage does not follow the input signal itself (and signals having double the frequency of the input signal, respectively) but fluctuations in the amplitude of the input signal. This output voltage may then be applied to the threshold value switch 12.

The resonant circuits, not shown, of the FM demodulator 6 ensure that the signal in the signal channel is subjected to such a delay that in the event of overmodulation the switch 11 is already energized before the effects produced by the overmodulation occur at the output of the FM-modulator.

But also if the switch were activated some microseconds too late this would not be disturbing, as the voltage shift of the output voltage of the discriminator then occurring would, at the occurrence of overmodulation with respect to the average output voltage outside overmodulation, be integrated only during this comparatively short period of time by the integrator 8 to 10, inclusive. It is therefore in principle also possible to derive the criterion for the operation of the switch 11 from the output voltage of the FM demodulator 6, it being possible to utilize the fact that an overmodulation is accompanied by a sudden change of the output signal of the FM demodulator 6, which change can be used for a switching control. To this end, a threshold value switch, which is energized when the input signal thereto exceeds a predetermined threshold value, must be connected to the output of the FM demodulator, preferably via a differentiating element and a high-pass filter, respectively, which amplifies the sudden change of the output voltage.

Just as it is not very annoying if switch 11 does not become active until shortly after the occurrence of the distortions produced by the overmodulation at the output of the FM demodulator 6, it is also not annoying that the switch 11 is already adjusted to its normal state, which in this case corresponds to blocking, before the effect occurring during the overmodulation at the output of the FM-demodulator, ends. Optionally, however, the return of the switch to the normal state may be effected with some delay. To that end it is, for example, possible to connect to the gate electrode of the field effect transistor 11, a capacitor the other end of which is connected to ground and which at the occurrence of a disturbance is rapidly charged by the threshold value switched 12 via a suitably poled diode and, after-changeover of the threshold value switch 12, is slowly discharged via a parallel-arranged resistor. It is alternatively possible to arrange, behind the threshold value switch 12, a monostable multivibrator which maintains the switch 11 in the conducting state for a time constant which would have to be larger than the duration of an average overmodulation. As a result thereof, the output signal of the integrator is indeed kept longer than necessary at a constant value, in certain circumstances during several periods of the sum signal, which however is not annoying in a stereo receiver, as then the change from mono to stereo reception is only delayed for a short period of time.

If the carrier is frequency-modulated instead of phase-modulated and has pre-emphasis, it is sufficient to add the resistor 14 (shown by means of a dashed line), arranged in parallel with the capacitor 10 of the integrator 8. . . 10, to the circuit shown in FIG. 1 with the requirement that the resistor 14 and the capacitor 10 together have a time constant which corresponds to the required de-emphasis.

Figure 2:
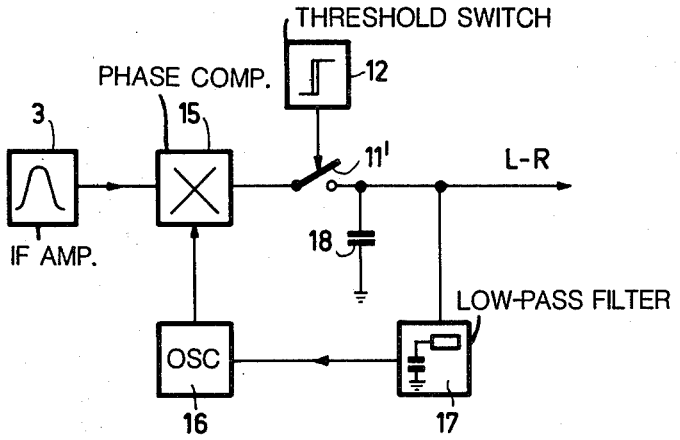
FIG. 2 shows an embodiment in which a PLL loop is provided as a phase demodulator.

FIG. 2 shows a portion of the block schematic circuit diagram of an embodiment which employs a PLL loop as a phase demodulator. The output signal of the intermediate frequency amplifier 3 is then applied to a first input of a phase comparator stage 15, for example a multiplier. A second input is connected to the output of an oscillator 16, which produces a signal the frequency of which depends on a d.c. voltage which is applied to a control input of the oscillator 16. Via a switch 11', which is normally closed but open during an overmodulation, the output of the phase comparator circuit 15 is connected to the further portion, not shown, of the receiver (for example the matrixing circuit) and, via a low-pass filter 17, which removes the audio signal components from the output signal of the phase comparator stage 15, to the control input of the oscillator 16, so that the frequency thereof is adjusted in accordance with the average value of the frequency of the input signal. The switch 11', which in all other respects can be controlled in a similar manner as the switch 11 in the circuit shown in FIG. 1, forms in conjunction with a capacitor 18, which connects the signal path behind the capacitor 11' to ground, a sample-and-hold circuit which, in the event of overmodulation, maintains the output signal at the value present prior to the overmodulation.

Although the invention is described in the foregoing as relating to the reception of stereo signals, the invention may alternatively be used if there is no relationship as to contents between the signals modulating the amplitude and phase or the frequency, respectively.

What is claimed is:

1. A receiver for receiving AM-signals the carrier being amplitude modulated with a first signal (L+R) and phase modulated with a second signal (L−R), said receiver comprising a signal channel having a phase demodulator as well as an electronic switch for blocking and releasing the signal channel, said electronic switch being controlled by an overmodulation detector, which is energized by an amplitude overmodulation of the carrier, characterized in that said phase demodulator comprises an FM-demodulator and a subsequent integrator, said electronic switch being connected between the FM-demodulator and the integrator.

2. A receiver as claimed in claim 1, characterized in that said switch is connected for short-circuiting the integrator input at the occurrence of an amplitude-overmodulation of the carrier so that the output thereof remains constant during the overmodulation.

3. A receiver for receiving AM-signals the carrier being amplitude modulated with a first signal (L+R) and phase modulated with a second signal (L−R), said receiver comprising a signal channel having a phase demodulator as well as an electronic switch for blocking and releasing the signal channel, said electronic switch being controlled by an overmodulation detector, which is energized by an amplitude overmodulation of the carrier, characterized in that said phase-demodulator comprises a phase locked loop, said electronic switch being included within the phase locked loop between a phase comparator of the phase locked loop and an integrator, the integrator being connected to an output of the phase locked loop and, through a low pass loop filter, to a control input of a voltage controlled oscillator of the phase locked loop.

* * * * *